United States Patent [19]

Huber et al.

[11] 3,983,272

[45] Sept. 28, 1976

[54] METHOD FOR IMPROVING THE LUBRICATING PROPERTIES AND IMPARTING ANTISTATIC PROPERTIES TO ORGANIC FIBERS

[75] Inventors: Peter Huber; Ewald Pirson; Helga Lampelzammer, all of Burghausen, Germany

[73] Assignee: Wacker-Chemie GmbH, Munich, Germany

[22] Filed: Jan. 24, 1975

[21] Appl. No.: 543,850

[30] Foreign Application Priority Data

Feb. 6, 1974 Germany ..... 2405717

[52] U.S. Cl. ..... 427/407 R; 252/8.6; 427/412; 427/416; 428/266; 428/391

[51] Int. Cl.[2] ..... D06M 13/28; D06M 15/66

[58] Field of Search ..... 428/391, 266, 447; 252/8.6; 427/407, 412, 416

[56] References Cited

UNITED STATES PATENTS

| | | | |
|---|---|---|---|
| 3,271,189 | 9/1966 | Hofmann | 428/391 X |
| 3,423,235 | 1/1969 | Campbell | 428/391 |
| 3,653,955 | 4/1972 | Habib | 427/412 X |
| 3,658,573 | 4/1972 | Guestaux et al. | 96/87 A |
| 3,717,500 | 2/1973 | Mastrianni | 427/412 X |
| 3,853,607 | 12/1974 | Iyengar et al. | 428/391 X |

*Primary Examiner*—Ralph Husack

[57] ABSTRACT

A method for improving the lubricity and antistatic properties of organic fibers comprising coating the fibers with a composition containing a diorganopolysiloxane, a phosphorous compound capable of imparting antistatic properties to the fibers, and, if desired, paraffin waxes.

8 Claims, No Drawings

METHOD FOR IMPROVING THE LUBRICATING PROPERTIES AND IMPARTING ANTISTATIC PROPERTIES TO ORGANIC FIBERS

The present invention relates to organic fibers having improved lubricity and antistatic properties and more particularly to a composition which imparts improved lubricity and antistatic properties to organic fibers treated therewith.

Heretofore, organic fibers have been treated with diorganopolysiloxanes to improve the lubricity or gliding ability of the organic fibers. Other materials such as oils and/or waxes such as paraffin waxes and/or antistatic inducing compounds such as calcium chloride, have been combined with the diorganopolysiloxanes to provide increased lubricity or gliding characteristics as well as antistatic properties to organic fibers. (See German patent applications DT-OS 1,619,001 and DT-OS 2,116,813 filed July 30, 1970, and June 20, 1973, respectively.) An increase in the fiber's lubricity or gliding ability decreases or avoids the danger of the fiber breaking or tearing when it is exposed to stress such as occurs in rapidly operating sewing machines or weaving looms.

The diorganopolysiloxane-based lubricants which have been applied heretofore to organic fibers have certain disadvantages. For example, they do not impart antistatic properties to the fibers, thereby increasing the danger that the thread may break due to the electrostatic charge and thus loosen the twist. Also, the conventional lubricants such as those which contain dimethylsiloxane units and siloxane units having alkyl radicals containing at least 14 carbon atoms are relatively difficult to produce. (See German patent application DT-AS 1,469,335.) Moreover, when a mixture containing a liquid dimethylpolysiloxane and the organic antistatic agents which have been used heretofore is applied to fibers, the resultant finish exhibits the undesirable properties of both components, such as poor lubricity or gliding properties and little, if any, electrostatic protection. (See German patent application DT-OS 1,619,001.) Moreover, the mixture can be used only as aqueous emulsions and thus easily separate into their respective components. Furthermore, these organic additives often generate odor producing reaction products when subjected to the heat produced during the sewing operations.

Therefore, it is an object of this invention to improve the lubricity or gliding properties of organic fibers. Another object of this invention is to improve the lubricity and also impart a high degree of antistatic properties to the fibers. Still another object of this invention is to improve the lubricity of organic fibers with organopolysiloxanes in which the organic groups are lower alkyl radicals. Still another object of this invention is to provide a low viscosity composition without having to use organic solvents. A further object of this invention is to provide a method for treating fibers with a composition containing small amounts of organopolysiloxanes.

The foregoing objects and others which will become apparent from the following description are accomplished in accordance with this invention, generally speaking, by coating organic fibers with a composition containing a diorganopolysiloxane having a viscosity of from 500 to 10,000 cSt. at 25°C. and from 0.1 to 30 parts by weight of a phosphorous compound capable of inducing antistatic properties for each 50 to 100 parts by weight of diorganopolysiloxane and, if desired, paraffin waxes. The coated fibers have improved lubricity or gliding properties and also have improved antistatic properties.

In the diorganopolysiloxane described above, at least 90 mol percent of the siloxane units are diorganosiloxane ($R_2SiO$) units. In general, the residual copolymer siloxane units are mostly triorganosiloxane ($R_3SiO_{1/2}$) units. These $R_3SiO_{1/2}$ units can sometimes be replaced by units corresponding to the general formula $R_2Si(OR')O_{1/2}$. In addition to the siloxane units described above, the diorganopolysiloxane can also contain up to 10 mol percent of other copolymer siloxane units, particularly $RSiO_{3/2}$ and/or $SiO_{4/2}$ units. In the above formulae, R represents the same or different monovalent hydrocarbon or substituted monovalent hydrocarbon radicals and R' represents hydrogen or a monovalent hydrocarbon radical. Examples of suitable monovalent hydrocarbon radicals are alkyl radicals having from 1 to 5 carbon atoms. Preferably, R' represents hydrogen or an alkyl radical having from 3 to 6 carbon atoms such as the tert.-butyl radical or an aryl radical such as the phenyl radical.

Since they are more readily available, it is preferred that at least 50 percent of the R radicals in the diorganopolysiloxanes employed in this invention be methyl radicals. Examples of other SiC-bonded organic radicals in the diorganopolysiloxanes are the ethyl, n-propyl, isopropyl, n-butyl, sec-butyl, n-amyl and the sec-amyl radicals. Also, R may represent an aryl radical such as the phenyl radical. Examples of substituted monovalent hydrocarbon radicals represented by R are the chloro substituted monovalent hydrocarbon radicals such as the chlorophenyl radicals.

The preferred diorganopolysiloxanes which may be employed in this invention may be represented by the general formula $$(CH_3)_3Si(OSi(CH_3)_2)_nOSi(CH_3)_3,$$

in which $n$ represents a number which corresponds to the previously indicated viscosity parameter of 500 to 10,000 cSt. at 25°C.

Although the diorganopolysiloxanes employed in this invention may have a viscosity of from 500 to 10,000 cSt. at 25°C., it is preferred that the viscosity be from 750 to 5,000 cSt. at 25°C.

These diorganopolysiloxanes may have a narrow molecular weight distribution, i.e., they may consist of diorganopolysiloxanes which have more or less the same viscosity. However, the diorganopolysiloxanes may also have a wide molecular weight distribution. For example, a mixture which contains diorganopolysiloxanes having various viscosities within the range of from 500 to 10,000 cSt. at 25°C. may be employed in this invention. Also, mixtures containing diorganopolysiloxanes having viscosities outside the range of from 500 to 10,000 cSt. at 25°C. may be employed such as, for example, a diorganopolysiloxane having a viscosity of 100 cSt. at 25°C., 250 cSt. at 25°C. and $10^6$ cSt. at 25°C. provided that the viscosity of the mixtures is within the range of from 500 to 10,000 cSt. at 25°C.

Phosphorous compounds which are capable of imparting antistatic properties to organic fibers may be represented by the general formula $$(O)\,P\,(OH)_x\,Y_{3-x}$$

in which Y represents the same or different monovalent hydrocarbon or hydrocarbonoxy radicals, $x$ is 0 if Y is a hydrocarbon radical and $x$ is 0, 1 or 2 if Y is a hydrocarbonoxy radical. Examples of suitable phosphorous compounds are phosphoric acid esters, partial esters of phosphoric acid and tert-phospheneoxide.

The hydrocarbon radicals represented by Y preferably have from one to 18 carbon atoms. Examples of suitable hydrocarbon radicals are alkyl radicals such as methyl, ethyl, n-butyl, sec-butyl, tert-butyl and 2-ethylhexyl, amyl, decyl, dodecyl, tetradecyl, and octadecyl radicals as well as mixtures containing from $C_8$ to $C_{12}$ alkyl radicals, aryl radicals such as the phenyl radical; alkaryl radicals such as tolyl and cresyl radicals; and aralkyl radicals such as the benzyl radical.

Specific examples of suitable phosphorous compounds are trimethylphosphate, triethylphosphate, tripropylphosphate, triisopropylphosphate, tributylphosphate, tripentylphosphate, tricresylphosphate, methylhydrogen ethylphosphonate, diethyl methylphosphonate, phenylphosphonic acid and the like.

Mixtures of various phosphorous compounds capable of imparting antistatic properties to organic fibers may also be employed in this invention.

When paraffin waxes are not employed, then phosphorous compounds, phosphoric acid esters and/or partial esters of phosphoric acid are preferred as the antistatic inducing agents.

However, when paraffin waxes are employed in these compositions, they may be employed in amounts up to about 50 parts by weight and more preferably in amounts of from about 0.5 to 20 parts by weight for each 50 to 100 parts by weight of diorganopolysiloxane. These paraffin waxes may be either natural or synthetic. Fully refined paraffins are preferred, i.e., those having an oil content of 0.5 percent, pure white in color and no odor and/or half-refined paraffins, i.e. those having an oil content of 1.0 to 2.5 percent, almost white in color and very little odor. (See "Ullmans Encyclopädie der technischen Chemie" Vol. 18, Munich-Berlin-Vienna 1967, page 274.)

Mixtures of various paraffin waxes may also be employed in these compositions. In order to achieve the most uniform impregnation of the fibers at the temperatures which are most frequently employed in treating the organic fibers, it is preferred that the paraffin waxes or the mixture of paraffin waxes have a melting range of from about 30°C. up to about 80°C. and more preferably between about 40°C. and 60°C.

It is preferred that the composition consisting of diorganopolysiloxanes, phosphorous compounds capable of inducing antistatic properties and paraffin waxes, if desired, be substantially free of solvents. This avoids the possibility of having to recover the solvent. Likewise, the composition of this invention avoids the disadvantages which are encountered in using aqueous emulsions. However, the possibility of using a solvent or an aqueous emulsion should not be excluded. When a solvent is employed, the composition may contain up to 100 percent by weight of an organic solvent such as aromatic hydrocarbons e.g., benzene, toluene, xylene, chlorohydrocarbons and dialkyl ethers, e.g., diethylether, methyl ethyl ether, di-n-butyl ether and the like.

The organic fibers which may be treated in accordance with this invention include all organic fibers which have been twisted one or more times. Examples of such twisted organic fibers are wool, cotton, rayon, hemp, natural silk, polypropylene, polyethylene, polyester, polyurethane, polyamide, cellulose acetate and polyacrylonitrile fibers, as well as mixtures of such fibers. The invented process is preferably applied to yarns. However, the twisted organic fibers may be in the form of finished fleeces, mats or knitted textiles including finished garments or parts of garments.

The composition consisting of a mixture of diorganopolysiloxanes, phosphorous compounds and paraffin waxes, if desired, can be applied to the fibers by any conventional technique known in the art such as by spraying, immersion, coating, calendering or by guiding the fibers over a surface which has been saturated with said mixture.

In order to achieve a very uniform impregnation of the fibers, it is preferred that the composition containing the diorganopolysiloxane, antistatic inducing phosphorous compounds and paraffin waxes, if desired, be applied at temperatures at which the phosphorous compounds and paraffin waxes melt into the diorganopolysiloxane. Generally the composition is applied at temperatures of from about 15°C. up to about 100°C. However, if paraffin wax is present in the composition, then the temperature at which the composition is applied to the fibers is primarily dependent on the melting temperature of the wax and the antistatic inducing phosphorous compounds.

The gliding or lubricating properties of the organic fibers are substantially improved if the twisted fibers are first treated with a composition of a diorganopolysiloxane having a viscosity of from 500 to 10,000 cSt at 25°C. and from 0.5 to 50 parts by weight of paraffin wax for each 50 to 100 parts by weight of the diorganopolysiloxane and from 0.1 to 30 parts by weight of a phosphorous compound capable of imparting antistatic properties thereto for each 50 to 100 parts by weight of diorganopolysiloxane. To achieve the aforementioned improved gliding and antistatic properties, the thus pretreated fibers are then coated with a diorganopolysiloxane having a viscosity of from 500 to 10,000 cSt at 25°C. which contains preferably from 0.1 to 30 parts by weight of an antistatic inducing phosphorous compound in solution for each 50 to 100 parts by weight of the diorganopolysiloxane. It is essential that the antistatic inducing agent also be employed in the second coating.

The embodiments of this invention are further illustrated by the following examples in which all percents are by weight unless otherwise specified.

EXAMPLES 1 through 10

In these Examples various treating compositions were applied to 500 meters of twisted (yarn) fibers by means of a traverse winder of the type "Praemat-Junior K" manufactured by the Sahm Company of Eschwege, West Germany. The yarns were guided over a drum which rotated in a reservoir containing the various treating compositions. The treated yarns were then weighed to determine the amount of treating composition absorbed thereon.

These treated yarns were used to sew four layers of a blue cotton material for work clothes with the aid of an industrial sewing machine (Type Pfaff 438) operating at a speed of 7,000 stitches per minute while using a thread tension device manufactured by Schmidt of Waldkraiburg, West Germany.

The following Table shows the thread tension and the average length of the seam at which the thread tore or broke after the sewing process had been repeated five times, thus illustrating the improved lubricity or gliding properties of the treated fibers.

The effectiveness of the antistatic coating is determined by repeatedly drawing the coated yarns through a linen cloth. The amount of electrostatic charge is illustrated in the following Table.

The term organopolysiloxane as used in the Examples refers to a trimethylsiloxy endblocked dimethylpolysiloxane.

In Examples 1 through 8 as well as in Comparison Examples $V_1$, $V_2$ and $V_3$ a white yarn is used consisting of a polyester staple fiber twisted three times in which 100 meters of untwisted yarn weighs one gram. (Type Mara made by the Gutermann Company).

In Example 8, the yarn was first coated with (a) a mixture containing a diorganopolysiloxane, a paraffin wax and a phosphorous compound, and thereafter coated with a second composition containing (b) a mixture of a diorganopolysiloxane and a phosphorous compound.

In Example 9 and Comparison Example $V_4$ a white yarn was used consisting of an endless polyester fiber, twisted three times in which 80 meters of the fiber weighs one gram. (Obtained from Gruschwitz Company.)

In Example 10, an olive green yarn was used consisting of an endless polyester fiber twisted three times in which 60 meters of the fiber weighs one gram. (Obtained from Ackermann Company.

TABLE

| Example No. | Organopolysiloxane Wt.%/Visc. cSt at 25°C. | Paraffin wax Wt.%/Melting Range | Phosphorous Compound* Wt.%/Type | Average viscosity of coating composition in cSt at a given application temperature | Absorption in Wt.% | Thread tension in grams | Stitch Length in cm | Electrostatic Charge** |
|---|---|---|---|---|---|---|---|---|
| 1 | 90/5000 | — | 10/LPP | 320/25 | 1.57 | 310–320 | 10.7 | − |
| 2 | 70/5000 | 20/44–48 | 10/LPP | 230/60 | 1.17 | 360–400 | 13.7 | − |
| 3 | 80/1000 | 10/52–54 | 10/DMDP | 250/70 | 1.44 | 380–400 | 12.3 | − |
| 4 | 90/1000 | — | 10/LPP | 200/25 | 1.56 | 360–380 | 11.2 | − |
| 5 | 95/1000 | — | 5/LPP | 250/25 | 1.74 | 350–370 | 10.7 | − |
| 6 | 99/1000 | — | 1/LPP | 390/25 | 2.35 | 370–390 | 12.5 | − |
| 7 | 75/5000 | 15/52–54 | 10/OAPP | 250/70 | 3.90 | 340–350 | 15.8 | − |
| 8(a) | 85/1000 | 10/52–54 | 5/APP | 270/70 | 2.50 | — | — | − |
| 8(b) | 90/2000 | — | 10/TEP | 350/25 | 2.30 | 290–310 | 35.0 | − |
| 9 | 90/5000 | — | 10/LPP | 325/25 | 1.27 | 350–370 | 9.3 | − |
| 10 | 75/1000 | 10/42–46 | 15/DMTP | 270/60 | 3.90 | 330–350 | 20.5 | − |
| Comparison Examples | | | | | | | | |
| $V_1$ | 100/250 | — | — | 250/25 | 10.31 | 430–450 | 7.3 | ++ |
| $V_2$ | 100/350 | — | — | 350/25 | 9.94 | 400–450 | 5.4 | ++ |
| $V_3$ | 75/250 | 15/52–54 | 10/OAPP | 105/70 | 6.80 | 550–600 | 5.7 | − |
| $V_4$ | 100/350 | — | — | 350/25 | 8.00 | 500–550 | 3.6 | ++ |

*Phosphorous Compounds
LPP = Lauryl-(dodecyl) phosphoric acid partial ester
DMDP = Dimethyldecylphospheneoxide
OAPP = 2-ethylhexyl-amyl phosphoric acid partial ester
APP = Amylphosphoric acid partial ester
TEP = Triethylphosphate
DMTP = Dimethyltetradecylphospheneoxide
**Electrostatic charge on the coating
− = No electrostatic charge
+ = Little electrostatic charge
++ = Considerable electrostatic charge Although specific examples of the invention have been described herein, it is not intended to limit the invention solely thereto, but to include all the variations and modifications falling within the scope of the appended claims.

What is claimed is:

1. A method for improving the lubricating properties and imparting antistatic properties to organic fibers which comprises coating twisted organic fibers with a composition consisting essentially of a diorganopolysiloxane having a viscosity of from 500 to 10,000 cSt at 25°C. in which the organo groups contain from 1 to 5 carbon atoms, from 0.1 to 30 parts by weight for each 50 to 100 parts by weight of the diorganopolysiloxane, of a phosphorous compound having the general formula $$(O)P(OH)_xY_{3-x}$$

in which Y represents a group selected from the class consisting of hydrocarbon and hydrocarbonoxy radicals, and when Y is a hydrocarbon radical $x$ is 0 and when Y is a hydrocarbonoxy radical $x$ is a number of from 0 to 2, and up to 50 parts by weight of a paraffin wax for each 50 to 100 parts by weight of the diorganopolysiloxane, said phosphorous compound being soluble in the diorganopolysiloxane and paraffin wax.

2. The method of claim 1 wherein the diorganopolysiloxane has a viscosity of from 750 to 5,000 cSt at 25°C.

3. The method of claim 1 wherein the phosphorous compound is selected from the class consisting of phosphoric acid esters and partial esters of phosphoric acid.

4. The method of claim 1 wherein the amount of paraffin wax is from 0.5 to 20 parts by weight for each 50 to 100 parts by weight of diorganopolysiloxane.

5. The method of claim 4 wherein the amount of phosphorous compound is from 0.1 to 30 parts by weight for each 50 to 100 parts by weight of diorganopolysiloxane.

6. The method of claim 4 wherein the paraffin wax is selected from the group consisting of fully refined paraffins and half-refined paraffins.

7. The method of claim 4 wherein the composition is applied to the fibers at a temperature which melts the paraffin wax and dissolves the phosphorous compound in the diorganopolysiloxane.

8. A method for improving the lubricating properties and imparting antistatic properties to organic fibers which comprises coating twisted organic fibers with a composition consisting essentially of a diorganopolysiloxane having a viscosity of from 500 to 10,000 cSt at 25°C. in which the organo groups contain from 1 to 5 carbon atoms, from 0.5 to 50 parts by weight of paraffin wax for each 50 to 100 parts by weight of diorganopolysiloxane and from 0.1 to 30 parts by weight for each 50 to 100 parts by weight of diorganopolysiloxane, of a phosphorous compound having the general formula $$(O)P(OH)_xY_{3-x}$$

in which Y represents a group selected from the class consisting of hydrocarbon and hydrocarbonoxy radicals, and when Y is a hydrocarbon radical $x$ is 0 and when Y is a hydrocarbonoxy radical $x$ is a number of from 0 to 2, and thereafter coating the coated fibers with a composition consisting essentially of a diorganopolysiloxane having a viscosity of from 500 to 10,000 cSt at 25°C. and from 0.1 to 30 parts by weight of the phosphorous compound having the above formula for each 50 to 100 parts by weight of diorganopolysiloxane.

* * * * *